US005370593A

United States Patent [19]

Wang

[11] Patent Number: 5,370,593

[45] Date of Patent: Dec. 6, 1994

[54] BEVEL SEATED ROWING MACHINE

[75] Inventor: Leao Wang, Taichung Hsien, Taiwan, Prov. of China

[73] Assignee: Greenmaster Industrial Corp., Taiping Hsiang, Taiwan, Prov. of China

[21] Appl. No.: 189,754

[22] Filed: Feb. 1, 1994

[51] Int. Cl.[5] ..... A63B 21/00

[52] U.S. Cl. ..... 482/72; 482/51

[58] Field of Search ..... 482/72, 73, 110, 111–112, 482/51, 148

[56] References Cited

U.S. PATENT DOCUMENTS

| | | | |
|---|---|---|---|
| 4,396,188 | 8/1983 | Dreissigacker et al. | 482/110 |
| 5,072,929 | 12/1991 | Peterson et al. | 482/72 |
| 5,122,105 | 6/1992 | Engel et al. | 482/72 |

FOREIGN PATENT DOCUMENTS

| | | | |
|---|---|---|---|
| 2227424 | 8/1990 | United Kingdom | 482/73 |

*Primary Examiner*—Stephen H. Crow
*Attorney, Agent, or Firm*—Bacon & Thomas

[57] ABSTRACT

A bevel seated rowing machine includes a bevel seated base frame to hold a rotary wheel, a first rope inserted through a through hole on the rotary wheel and having two opposite ends wound round two opposite tubular flanges on the rotary wheel in the counter-clock wise direction and then connected to the actuating rod of a hydraulic cylinder by a link, and a second rope wound round the rotary wheel in the clockwise direction and coupled with a handle for pulling, wherein the link is comprised of a connecting bar and a T-bolt connected through a screw joint and turned in either direction to adjust the tension of the first rope.

2 Claims, 4 Drawing Sheets

BEVEL SEATED ROWING MACHINE

BACKGROUND OF THE INVENTION

The present invention relates to rowing machines, and more particularly to a bevel seated rowing machine.

Several known rowing machines have appeared on the market. For example, U.S. Pat. No. 4,606,538 discloses a physical exercise device which comprises a base having a bracket at one end, a seat member detachably engaged with the base, a supporting frame having one end detachably engaged with the bracket, a handling means having a connecting plate pivotally engaged to the other end of the supporting frame, and a hydraulic cylinder having one end pivotally connected to the supporting frame and the other end detachably connected to the connecting plate for producing hydraulic resistance. This physical exercise device is not satisfactory in function because the user must bend the body forcibly and then erect the trunk again during each stroke of rowing, thereby causing the user to tire quickly.

U.S. Pat. No. 4,621,623 discloses a multi-function gymnastic device which is composed of a pedestal capable of being erected, and two rocker components installed on two sides of the pedestal and capable of being assembled horizontally when the pedestal is in the erected state. The rocker components can be pushed and pulled to-and-fro for boat-rowing sports, up-and-down for chest-expanding sports, and moved around 360° to change the mode of sports and achieve the effect of multi-function sports. This gymnastic device further comprises two hydraulic cylinders engaged to the rockers to provide hydraulic resistance. One drawback of this gymnastic device is its complicated structure and high cost. Another drawback of this gymnastic device is that the hydraulic cylinders may produce different hydraulic resistance, thereby causing the user difficulty in moving the rockers evenly and smoothly. Still another drawback of this gymnastic device is that the user must bend the trunk through a big angle during exercises, thereby causing pain to the midsection of the user.

Chinese Patent No. 78,200,017 discloses a rowing machine which uses a flywheel to produce resistance. This rowing machine is complicated and expensive, and cannot eliminate the aforesaid drawbacks. Furthermore, the flywheel produces noises during the operation of the machine.

SUMMARY OF THE INVENTION

The present invention eliminates the aforesaid drawbacks of the prior art devices. It is therefore an object of the present invention to provide a rowing machine which is simple in structure. It is another object of the present invention to provide a rowing machine which is inexpensive to manufacture. It is still another object of the present invention to provide a rowing machine which is seated in a sloping position to assist the user to exercise the body smoothly without causing pain to the midsection of the user. It is also another object of the present invention to provide a rowing machine which uses a first rope and a second rope respectively wound around a rotary wheel in reverse directions for boat-rowing sports, and a hydraulic cylinder to provide uniform hydraulic resistance to the rotary wheel. It is still yet another object of the present invention to provide a link to connect the hydraulic cylinder to the first rope and allow the tension of the first rope to be adjusted.

DETAILED DESCRIPTION OF THE PREFERRED EMBODIMENT

Figure 1:
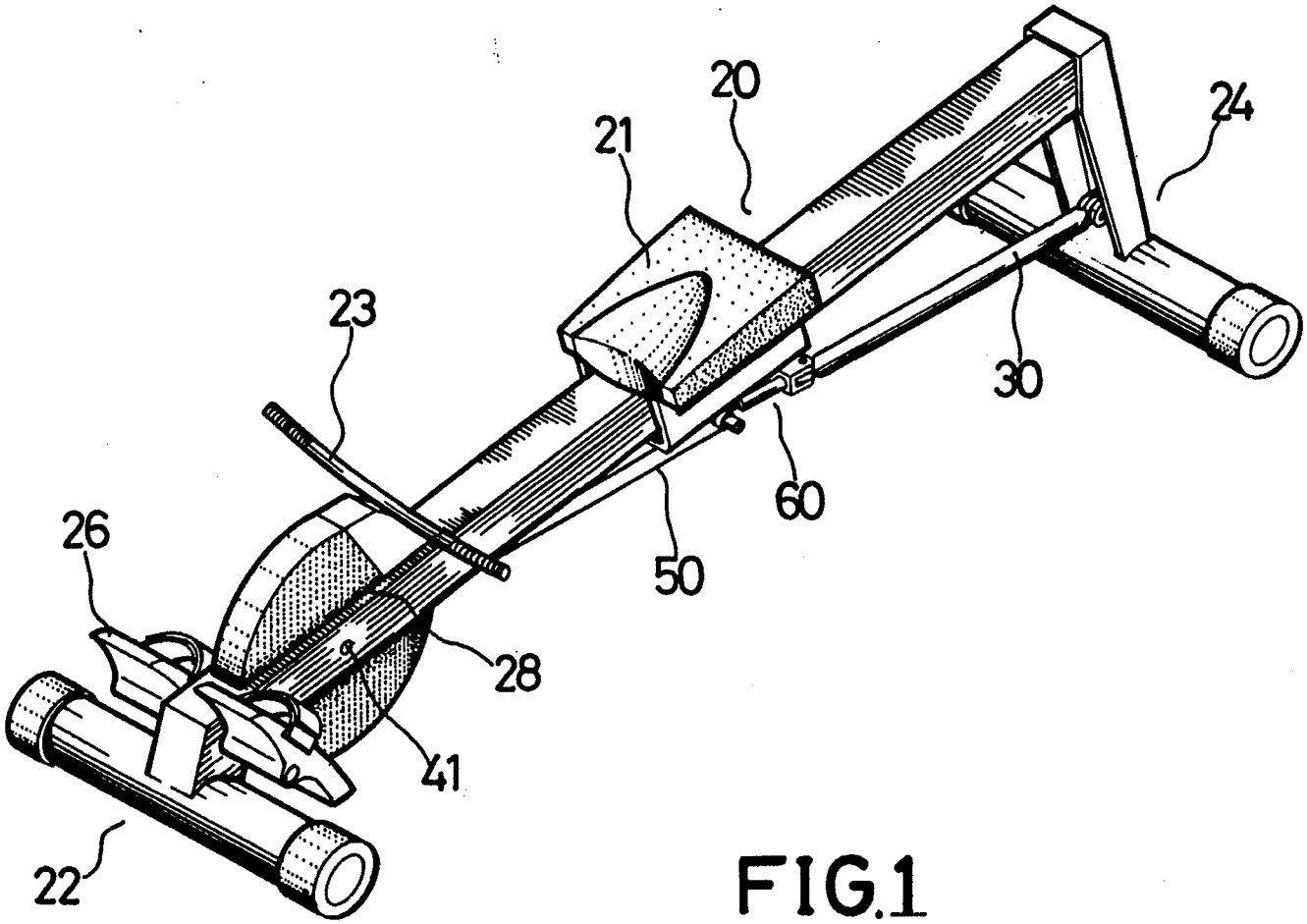
FIG. 1 is a perspective view of a bevel seated rowing machine according to the preferred embodiment of the present invention.

Referring to FIG. 1, the rowing machine of this invention comprises an elongated base frame 20 supported on two stands 22 and 24 positioned at different heights at two opposite ends to dispose frame 20 in a sloping position, a sliding seat 21 mounted on the elongated base frame 20 and releasably securable at a desired location, two foot boards 26 bilaterally mounted on the front stand 22, a hydraulic cylinder 30 mounted on the rear stand 24 and disposed below the base frame 20, and a rotary wheel 40 mounted on an axle 41 and transversely disposed within a slot 28 on the elongated base frame 20 near the foot boards 26.

Figure 3:
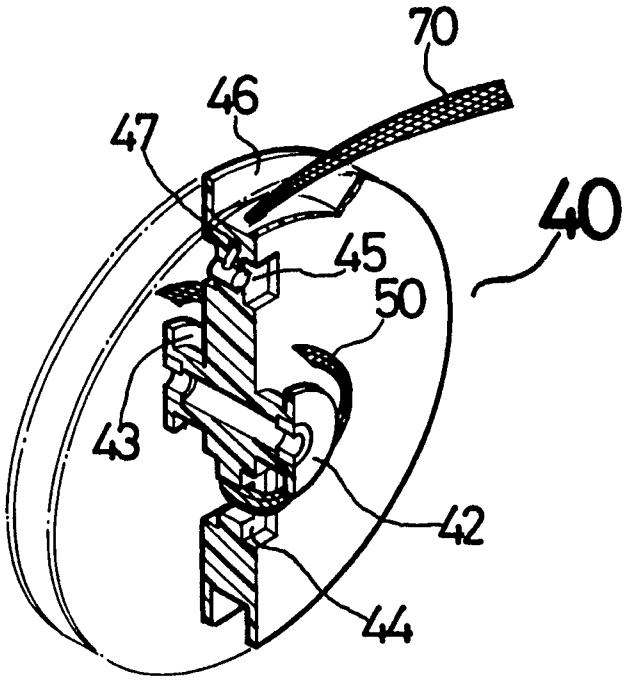
FIG. 3 is a perspective cutaway view of the rotary wheel shown in FIG. 2.
Figure 2:
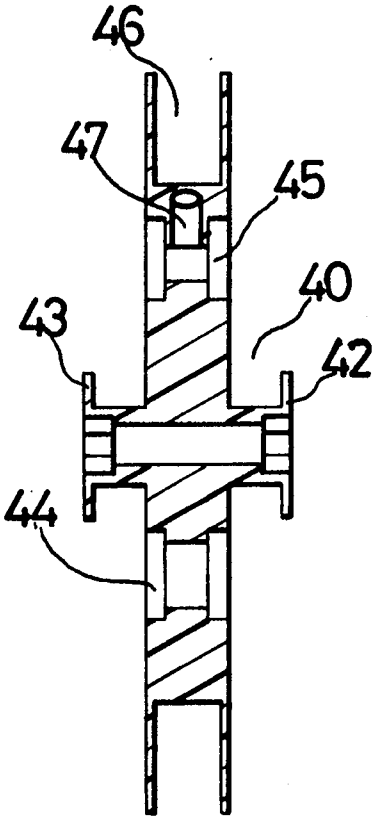
FIG. 2 is a sectional view of a rotary wheel for the bevel seated rowing machine shown in FIG. 1.
Figure 4:
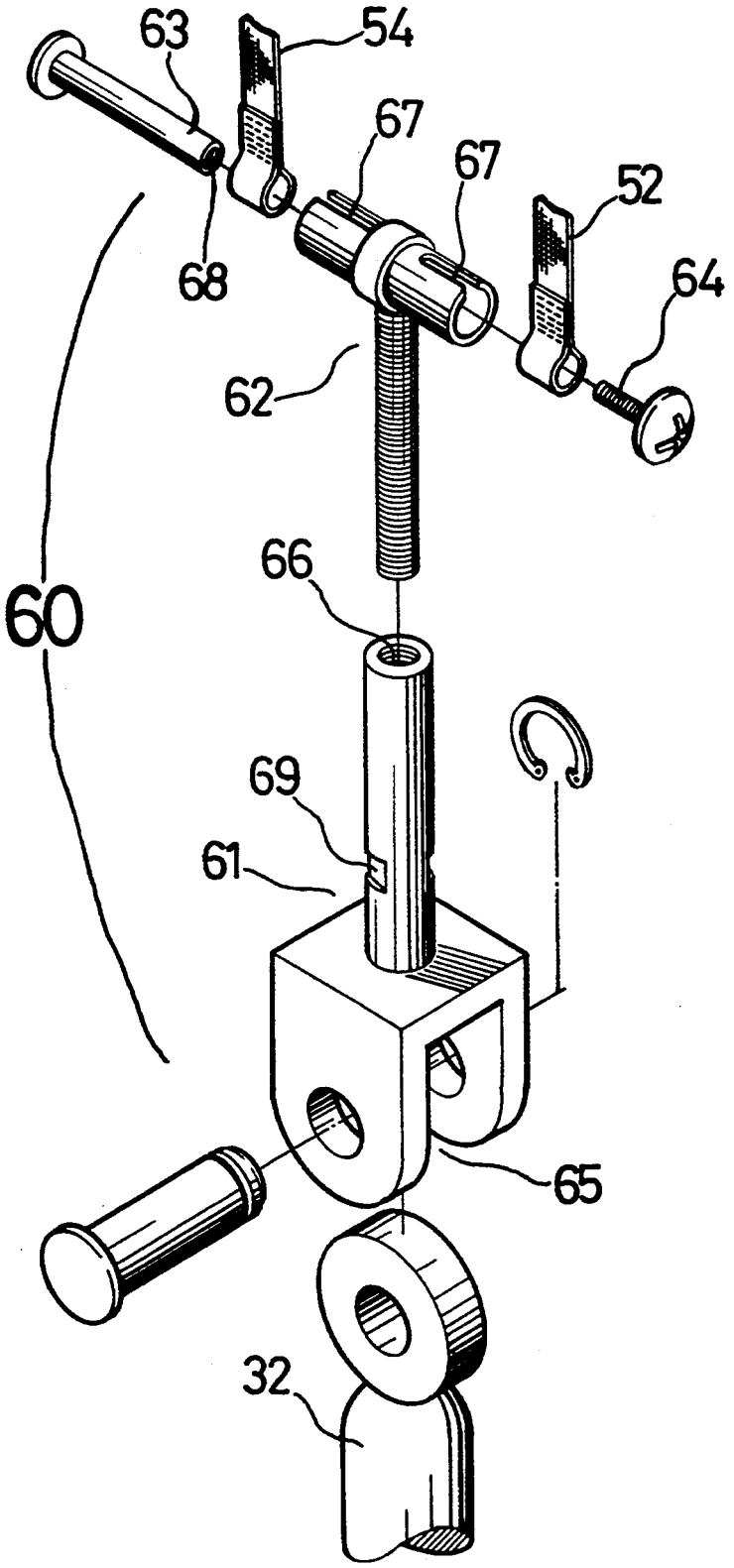
FIG. 4 is an exploded view of a link used in the present invention.

Referring further to FIGS. 2, 3 and 4, the rotary wheel 40 comprises a groove 46 around the periphery thereof, two tubular flanges 42 and 43 longitudinally aligned in the center at two opposite sides and respectively mounted around the axle 41, a first through hole 44 and a second through hole 45 respectively disposed in parallel with the tubular flanges 42 and 43 at two opposite locations, a wire hole 47 providing communication between the peripheral groove 46 and the second through hole 45. A first rope 50 is inserted through the first through hole 44 and includes two opposite ends 52 and 54 respectively wound around the tubular flanges 42 and 43 in the same clockwise direction and then connected to the actuating rod 32 of the hydraulic cylinder 30 through a link 60. There is provided a second rope 70 having one end inserted through the wire hole 47 and retained in the second through hole 45, and an opposite end wound around the peripheral groove 46 in the counter-clockwise direction and then coupled to a handle 23.

Figure 5:
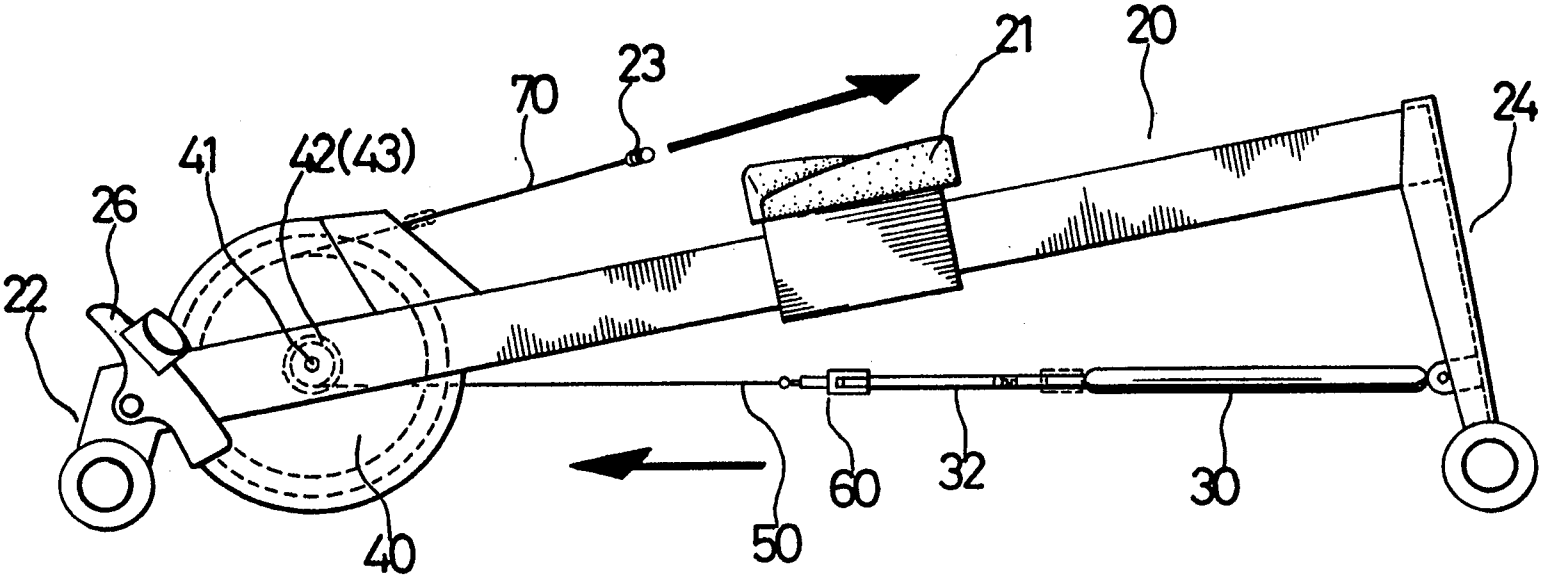
FIG. 5 is a side view of the bevel seated rowing machine shown in FIG. 1.

As seen in FIGS. 4 and 5, the link 60 is comprised of a connecting bar 61 having a lug 65 at one end connected to the actuating rod 32 of the hydraulic cylinder 30 and an axially extending inner thread 66 at an opposite end, a T-bolt 62 threaded into the inner thread 66 of the connecting bar 61 and having a tubular, slotted head 67, a headed rod 63 inserted through the tubular, slotted head 67 of the T-bolt 62 to secure the two opposite ends 52 and 54 of the first rope 50 to the T-bolt 62, and a headed screw 64 threaded into the screw hole 68 on the headed rod 63 secure rod 63 to the T-bolt 62.

Referring to FIG. 5, when the user sits on the seat 21 with the feet resting on the foot boards 26 and the hands holding the handle 23, the handle 23 is then pulled backwards toward the seat 21 to pull the second rope 70. When the second rope 70 is pulled backwards, the rotary wheel 40 is turned clockwise, causing the tubular flanges 42 and 43 to take up the two opposite ends 52 and 54 of the first rope 50, and therefore the actuating rod 32 is pulled out of the hydraulic cylinder 30. When the handle 23 is released, the actuating rod 32 is moved back to its former position, causing the rotary wheel 40 to turn counter-clockwise, thus rewinding the second rope 70.

Referring to FIG. 4, the connecting bar 61 has planes 69 formed around the periphery thereof for engagement by a hand tool to permit the T-bolt 62 to be turned in the inner thread 66 in either direction to adjust the tension of the first rope 50.

While only the preferred embodiment of the present invention has been shown and described, it will be understood that various modifications and changes may be made without departing from the spirit and scope of the invention.

What is claimed is:

1. A bevel seated rowing machine comprising an elongated base frame supported between a front stand and a rear stand in a sloping position, a sliding seat mounted on said base frame, two foot boards bilaterally mounted on said front stand, a rotary wheel received in a slot on said elongated base frame and rotatable on an axle fastened in said slot, a hydraulic cylinder affixed to said rear stand and having an actuating rod moved to produce hydraulic resistance, a first rope connected between said rotary wheel and said actuating rod, a second rope having one end connected to said rotary wheel and an opposite end coupled with a handle for pulling, and a link joined between said first rope and said actuating rod; wherein said rotary wheel included a peripheral groove around the periphery thereof, two tubular flanges longitudinally aligned in the center at two opposite sides and respectively mounted around said axle, a first through hole and a second through hole respectively disposed in parallel with said tubular flanges at two opposite locations, a wire hole interconnecting said peripheral groove and said second through hole; said first rope is inserted through said first through hole, having two opposite ends respectively wound round said tubular flanges in the clockwise direction and then connected to said link; said second rope has one end inserted through said wire hole and retained in said second through hole, and an opposite end wound around said peripheral groove in the counter-clockwise direction and then coupled to said handle.

2. The bevel seated rowing machine of claim 1 wherein said link is comprised of a connecting bar having a lug at one end connected to said actuating rod and an inner thread at an opposite end in the axial direction, a T-bolt threaded into the inner thread of said connecting bar and having a tubular head, a headed rod inserted through the tubular head of said T-bolt and fastened with a headed screw to hold the two opposite ends of said first rope to said T-bolt.

* * * * *